US011840839B2

(12) United States Patent
Lindl

(10) Patent No.: US 11,840,839 B2
(45) Date of Patent: Dec. 12, 2023

(54) APPARATUS FOR CLEANING GUTTERS AND METHODS OF USE

(71) Applicant: LINDL&DODGELLC, Billings, MT (US)

(72) Inventor: James R. Lindl, Knoxville, TN (US)

( * ) Notice: Subject to any disclaimer, the term of this patent is extended or adjusted under 35 U.S.C. 154(b) by 19 days.

(21) Appl. No.: 17/646,306

(22) Filed: Dec. 29, 2021

(65) Prior Publication Data

US 2022/0220743 A1 Jul. 14, 2022

Related U.S. Application Data

(60) Provisional application No. 63/136,495, filed on Jan. 12, 2021.

(51) Int. Cl.

| | |
|---|---|
| ***E04D 13/076*** | (2006.01) |
| ***A47L 5/14*** | (2006.01) |
| ***A47L 5/36*** | (2006.01) |
| ***A47L 9/32*** | (2006.01) |
| ***E01H 1/08*** | (2006.01) |
| ***B08B 1/00*** | (2006.01) |
| ***B08B 5/02*** | (2006.01) |

(52) U.S. Cl.

CPC ..... *E04D 13/0765* (2013.01); *A47L 5/14* (2013.01); *A47L 5/36* (2013.01); *A47L 9/327* (2013.01); *B08B 1/005* (2013.01); *B08B 5/02* (2013.01); *E01H 1/0818* (2013.01)

(58) Field of Classification Search

CPC . E04D 13/0765; E01H 1/0818; A47L 9/0488; A47L 9/06; A47L 9/066; A47L 9/0673; A47L 9/08; A47L 9/24; A47L 9/242; A47L 9/244; A47L 9/248; A47L 9/327; A47L 5/14; A47L 5/36; A47L 9/062; A47L 9/067; A47L 9/0626; B08B 5/02; B08B 9/02; B08B 1/005; D01H 11/005

USPC ..... 15/414, 415.1, 416, 420

See application file for complete search history.

(56) References Cited

U.S. PATENT DOCUMENTS

| | | | | |
|---|---|---|---|---|
| 2,630,907 | A | 3/1953 | Miller | |
| 3,286,314 | A | 11/1966 | Oetiker | |
| 4,402,106 | A * | 9/1983 | Mattson | E04D 13/0765 15/406 |
| 4,750,883 | A | 6/1988 | Drake | |
| 5,022,586 | A | 6/1991 | Putnam | |
| 5,083,340 | A * | 1/1992 | Takahashi | A47L 9/02 15/418 |
| 6,257,256 | B1 * | 7/2001 | Fischer | B08B 3/026 134/167 C |
| 10,760,276 | B2 | 9/2020 | Lindl | |

(Continued)

FOREIGN PATENT DOCUMENTS

| | | | | |
|---|---|---|---|---|
| AU | 2011100760 | A4 * | 8/2011 | E04D 13/0765 |

*Primary Examiner* — Tom Rodgers
*Assistant Examiner* — Sidney D Hohl
(74) *Attorney, Agent, or Firm* — LAW OFFICES OF MICHAEL L. WISE, LLC

(57) ABSTRACT

A tool for cleaning gutters includes a specialized nozzle that may be attached to a leaf blower via a set of rigid tubing. The nozzle transitions from a tubular shape into a mouth-like opening with a first projection in opposed, spaced relation to a second projection. The tool is particularly well suited to removing debris from gutters with the nozzle in contact with a gutter and made to expel high-velocity air.

14 Claims, 6 Drawing Sheets

(56) References Cited

U.S. PATENT DOCUMENTS

| | | | | |
|---|---|---|---|---|
| 2004/0143931 | A1* | 7/2004 | Dennis | A47L 5/14 15/405 |
| 2005/0115766 | A1 | 6/2005 | Corston | |
| 2008/0163561 | A1 | 7/2008 | Lenney et al. | |
| 2011/0002734 | A1* | 1/2011 | Chen | B25G 3/26 403/350 |
| 2013/0298351 | A1* | 11/2013 | Romito | A47L 9/08 15/405 |
| 2014/0075705 | A1* | 3/2014 | Ross | E01H 1/105 15/246 |
| 2016/0201330 | A1* | 7/2016 | Paton | A47L 5/24 15/340.1 |
| 2017/0191272 | A1 | 7/2017 | Ashton-Miller et al. | |

* cited by examiner

Fig. 3
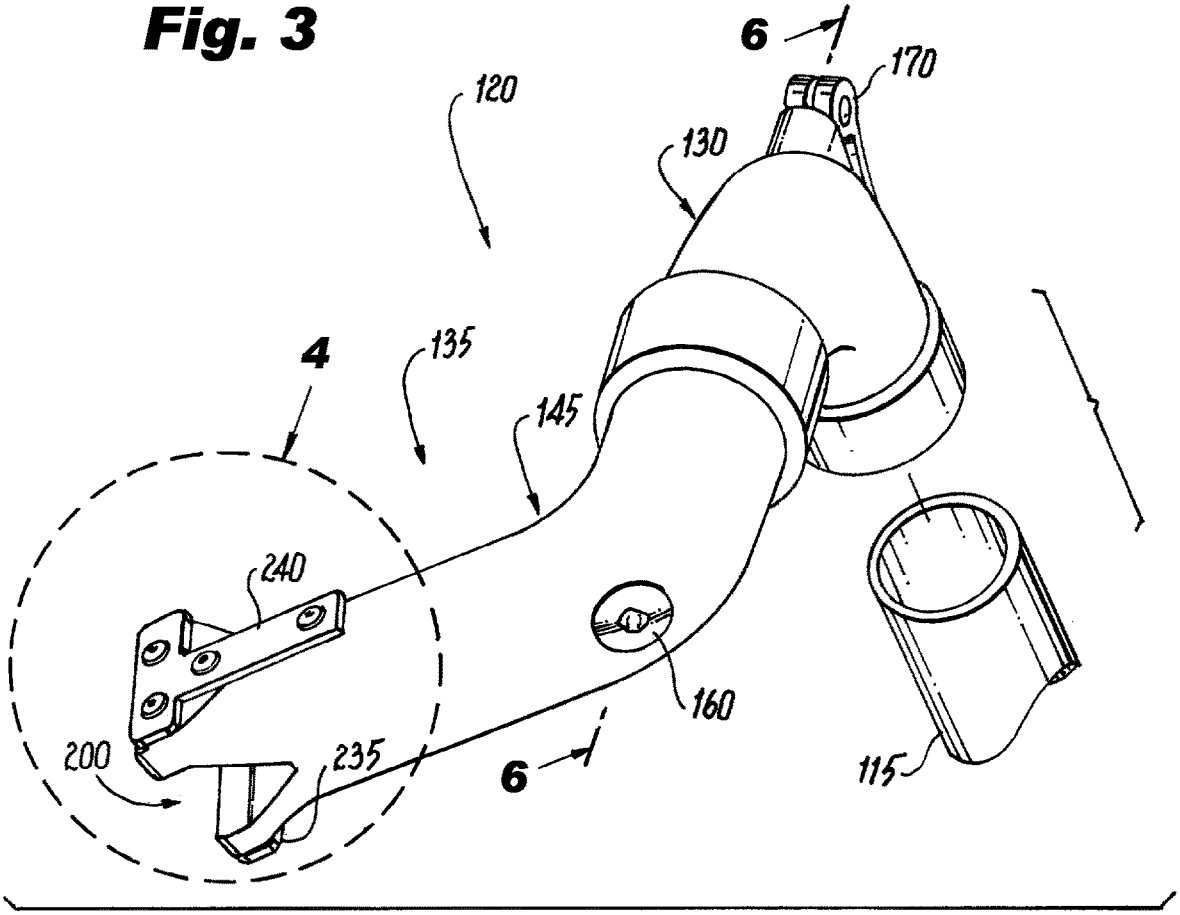
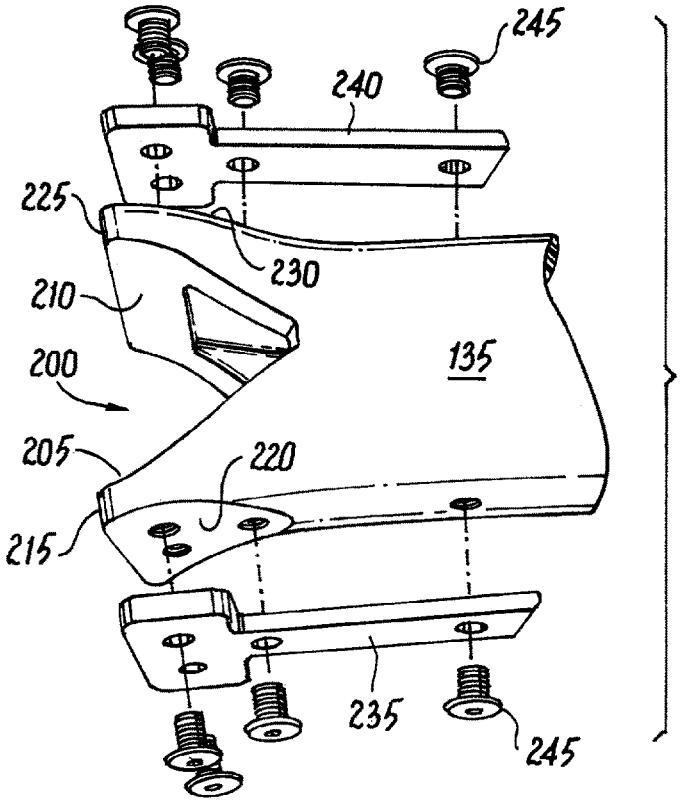
Fig. 4

Fig. 5
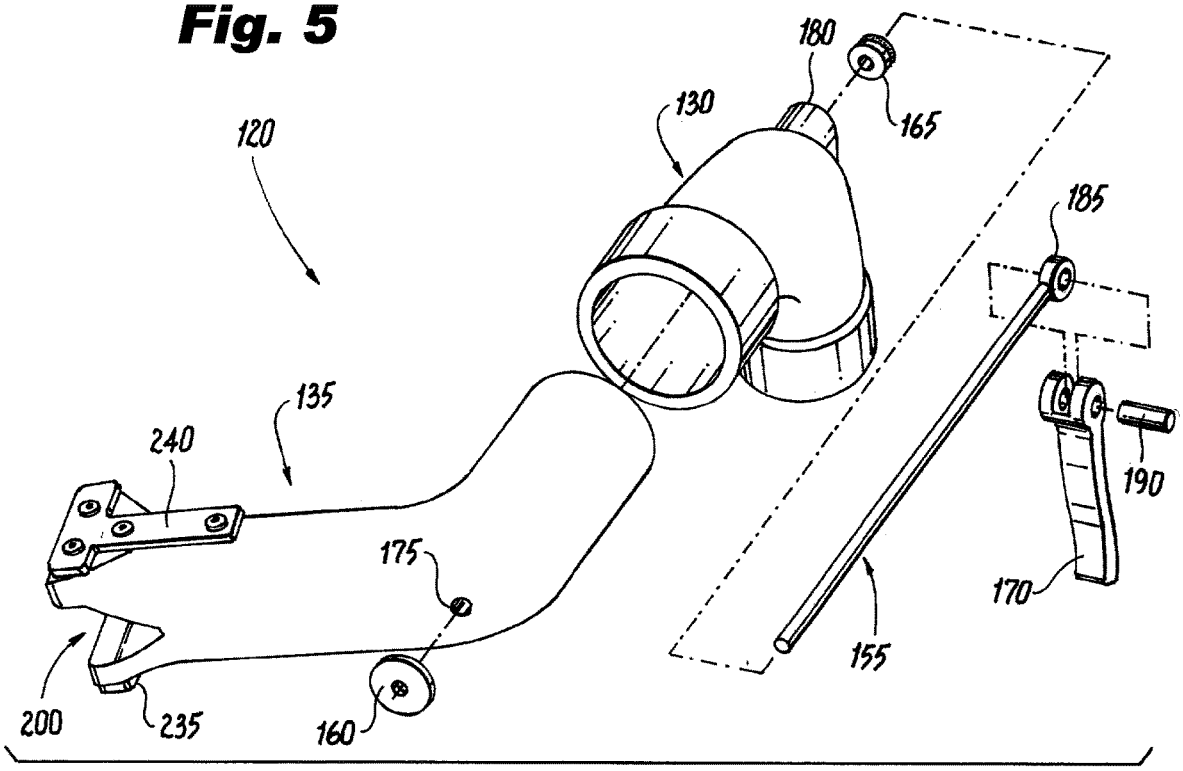
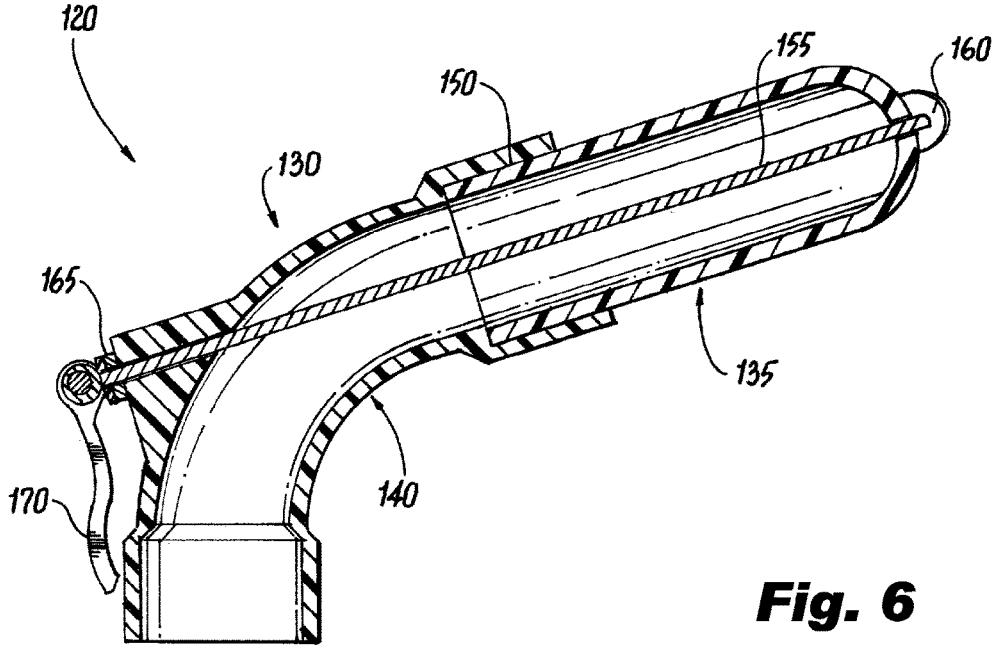
Fig. 6

Fig. 9
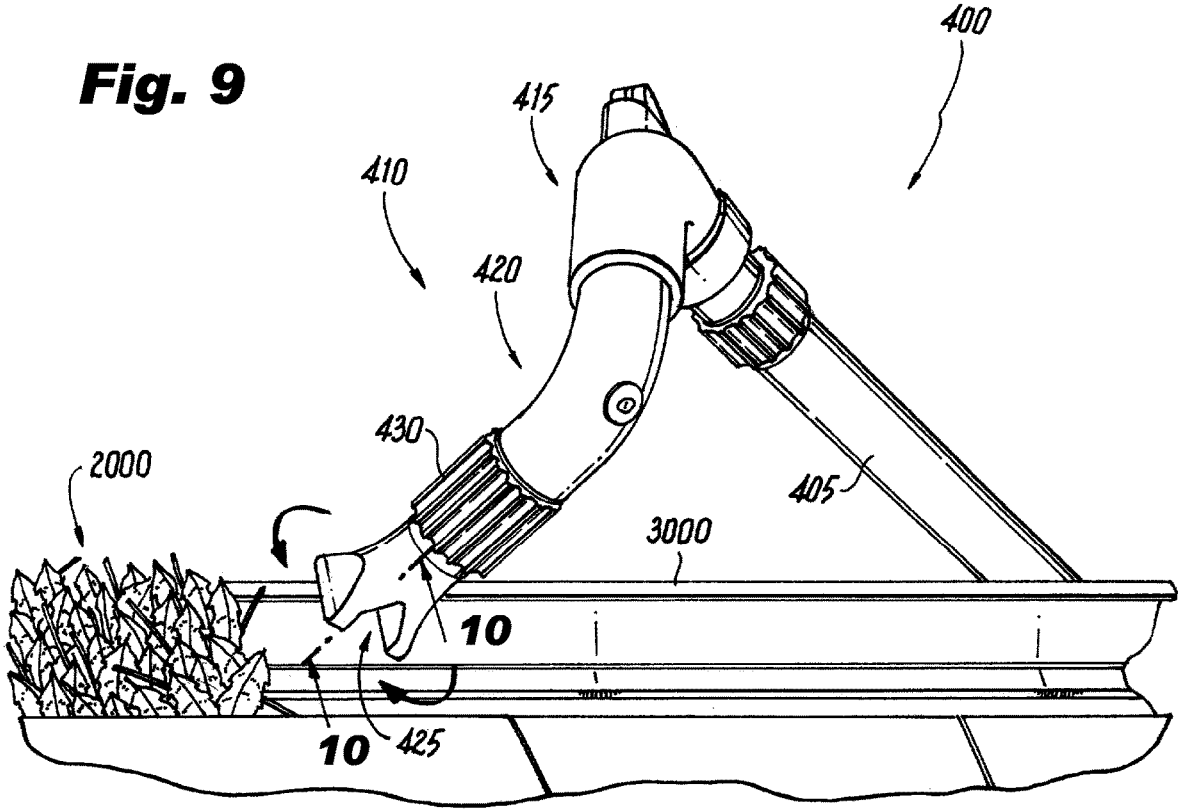
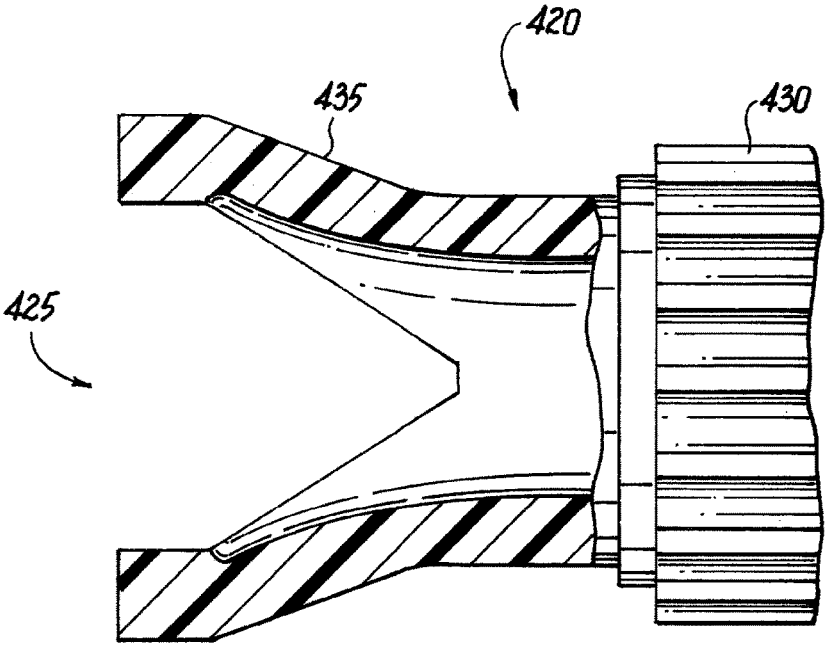
Fig. 10

APPARATUS FOR CLEANING GUTTERS AND METHODS OF USE

FIELD OF THE INVENTION

The present invention relates generally to cleaning means, and, more particularly, to apparatus and methods for cleaning debris from gutters.

BACKGROUND OF THE INVENTION

While cleaning house gutters of leaves and other debris remains a task that few look forward to doing, failure to do so can cause major issues for a home. Blockages can, for example, cause water to pour over the sides of a gutter and pool around the foundation of the house. This water can cause the foundation to crack and can lead to the growth of mold. In colder weather, a blocked gutter can form an ice dam, a ridge of ice that forms at the edge of a roof and prevents melting snow from draining off the roof. The backed-up water can eventually leak into the home, causing damage to walls, ceilings, insulation, and other areas.

Gutters are conventionally cleaned by getting on a ladder and manually removing the debris. Unfortunately, falls from ladders are quite common, and hundreds of injuries and deaths result every year as a result. Solutions that do not require accessing a gutter by ladder typically involve attaching long tubular attachments to leaf blowers, dry vacuums, or pressure washers. However, these attachments remain difficult to use and may not provide acceptable results.

For the foregoing reasons, there is a need for new apparatus and methods that allow gutters to be effectively cleaned in an easy and safe manner.

SUMMARY OF THE INVENTION

Embodiments of the present invention address the above-identified needs by providing apparatus and methods for cleaning gutters.

Aspects of the invention are directed to an apparatus comprising rigid tubing and a nozzle assembly attached to the rigid tubing. The nozzle assembly comprises a proximal nozzle portion characterized by a tubular shape and defining a first bend, and a distal nozzle portion attached to the proximal nozzle portion and defining a second bend. The distal nozzle portion transitions distally from a tubular shape into a mouth-like opening with a first projection in opposed, spaced relation to a second projection.

Additional aspects of the invention are directed to a method including obtaining an apparatus comprising rigid tubing, a nozzle assembly attached to the rigid tubing, a blower, and flexible tubing spanning between the blower and the rigid tubing. The nozzle assembly comprises a proximal nozzle portion characterized by a tubular shape and defining a first bend, and a distal nozzle portion attached to the proximal nozzle portion and defining a second bend. The distal nozzle portion transitions distally from a tubular shape into a mouth-like opening with a first projection in opposed, spaced relation to a second projection. After all of these elements are obtained, the apparatus is placed in contact with a gutter. Air from the blower is propelled through the flexible tubing, the rigid tubing, and the nozzle assembly into the gutter.

BRIEF DESCRIPTION OF THE DRAWINGS

These and other features, aspects, and advantages of the present invention will become better understood with regard to the following description, appended claims, and accompanying drawings where:

FIG. 3 shows a top perspective view of the nozzle assembly in the FIG. 1 apparatus;

FIG. 4 shows a bottom exploded perspective view of the nozzle assembly in the FIG. 1 apparatus;

FIG. 5 shows a top exploded perspective view of the nozzle assembly in the FIG. 1 apparatus;

FIG. 6 shows a sectional view of the nozzle assembly in the FIG. 1 apparatus along the cleave plane indicated in FIG. 3;

FIG. 9 shows a perspective view of a modified apparatus in accordance with another illustrative embodiment of the invention being used to clean debris from the gutter; and FIG. 10 shows a sectional view of the FIG. 9 modified apparatus along the cleave plane indicated in FIG. 9.

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

As used herein and in the appended claims, "about," when used to modify an angle, means within plus or minus ten degrees. "Directly" means without any intervening elements.

Figure 1:
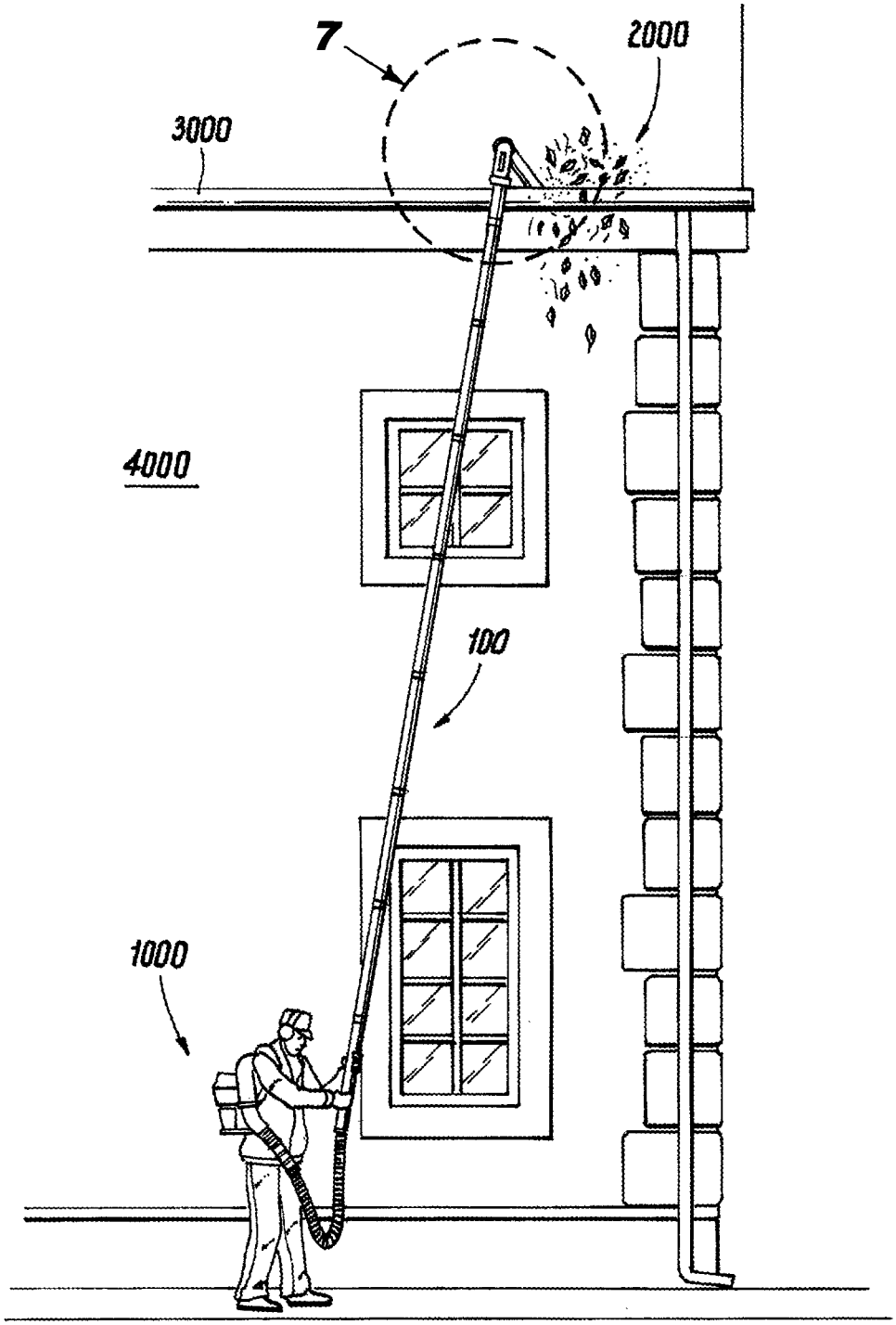
FIG. 1 shows a perspective view of a user using an apparatus in accordance with an illustrative embodiment of the invention to remove debris from a gutter attached to a two-story building.

Aspects of the invention are directed to an apparatus for removing leaves and other debris from rain gutters associated with buildings. FIG. 1 shows a perspective view of a user 1000 using an apparatus 100 in accordance with an illustrative embodiment of the invention to remove debris 2000 from a gutter 3000 attached to a two-story building 4000. The apparatus 100 allows the user 1000 to propel high-velocity air into the gutter 3000 to cause the debris 2000 therein to be expelled from the gutter 3000 and to fall to the ground. There, the debris 2000 can be safely collected and discarded. The gutter 3000 is thereby cleaned while the user 1000 stays safely on the ground, and issues associated with blockages are avoided by effectively cleaning the gutter 3000.

Figure 2:
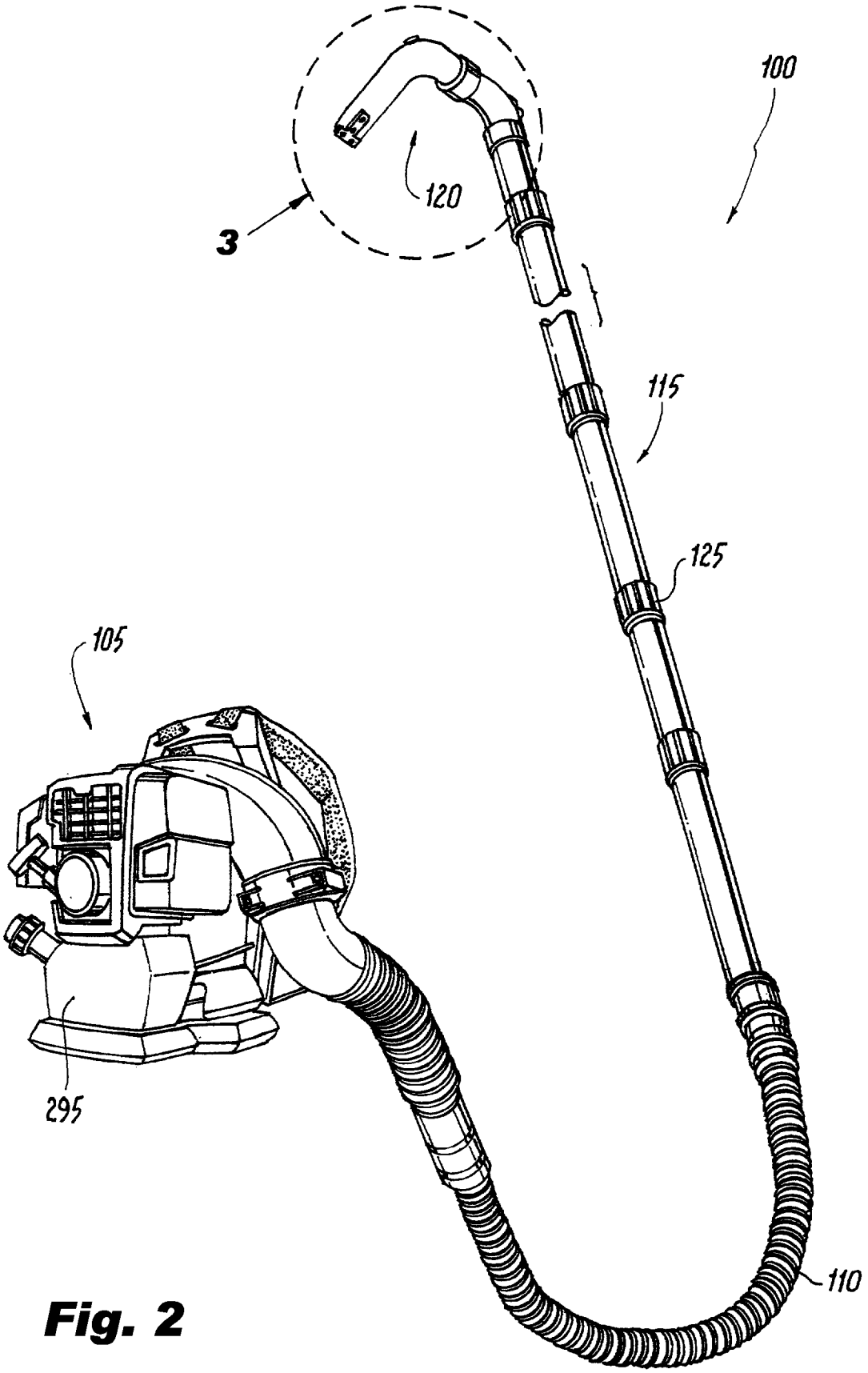
FIG. 2 shows a perspective view of the FIG. 1 apparatus alone.

Additional details of the illustrative apparatus 100 are shown in FIG. 2, which shows a perspective view of the apparatus 100 alone without other added elements. The apparatus 100 comprises: a blower 105, flexible tubing 110, rigid tubing 115, and a nozzle assembly 120. The nozzle assembly 120 is attached to the rigid tubing 115, which, in turn, is connected to the flexible tubing 110. The flexible tubing 110 is attached to an output of the blower 105 so as to span between the flexible tubing 110 and the rigid tubing 115. So configured, an interior of the nozzle assembly 120 is in gaseous communication with an interior of the rigid tubing 115 and an interior of the flexible tubing 110. The blower 105 is thereby able to propel high-velocity air through the flexible tubing 110, the rigid tubing 115, and out the nozzle assembly 120.

In the apparatus 100, the rigid tubing 115 is provided in segments with compression collars 125 between segments to removably join one segment to another. Each segment of the rigid tubing 115 is smaller in diameter than the previous, providing the rigid tubing 115 with a telescoping capability, which allows its overall length to be readily adjusted via the compression collars 125. The nozzle assembly 120 also includes a small segment of rigid tubing 115 at the nozzle assembly's proximal end. This small segment of rigid tubing 115 attaches the nozzle assembly 120 to the remainder of the rigid tubing 115 via a compression collar 125.

Aspects of the nozzle assembly 120 are described in FIGS. 3-6, with FIG. 3 showing a top perspective view of the nozzle assembly 120 in association with a top of the rigid tubing 115, FIG. 4 showing a side exploded perspective view of the nozzle assembly 120, FIG. 5 showing a top exploded perspective view of the nozzle assembly 120, and FIG. 6 showing a sectional view of the nozzle assembly 120 along the cleave plane indicated in FIG. 3. The nozzle assembly 120 can be conceptually broken down into two portions: a proximal nozzle portion 130 and a distal nozzle portion 135. The proximal nozzle portion defines a first bend 140 (FIG. 6), while the distal nozzle portion 135 defines a second bend 145 (FIG. 3).

The distal nozzle portion 135 is removably attached to the proximal nozzle portion 130. More particularly, the distal nozzle portion 135 defines an insertable region 150 that may be inserted into the distal nozzle portion 135. At the same time, a rod 155, a washer 160, a rubber bumper 165, and a clamping handle 170 are implemented to draw the two nozzle portions 130, 135 together. A distal end of the rod 155 emerges from a distal hole 175 in the distal nozzle portion 135 and terminates in the washer 160. A proximal end of the rod emerges from a proximal hole 180 in the proximal nozzle portion 130, passes through the rubber bumper 165, and terminates in an eyelet 185. The clamping handle 170 engages the eyelet 185 via a pin 190. The rod 155 thereby spans between the distal nozzle portion 135 and the proximal nozzle portion 130. Rotating the clamping handle 170 into its downward position causes an eccentric cam in the clamping handle 170 to place a tensional force on the rod 155. This tensional force acts to draw the proximal and distal nozzle portions 130, 135 together.

In addition to holding the proximal and distal nozzle portions 130, 135 together, the above-described drawing means also allows the orientation of the distal nozzle portion 135 to be quickly modified in relation to the proximal nozzle portion 130. Such a modification can be accomplished by manually raising the clamping handle 170 to relieve some of the tension on the rod 155, and then rotating the distal nozzle portion 135 relative to the proximal nozzle portion 130 about a rotational axis that is colinear with the rod 155. Once the desired orientation is reached, the clamping handle 170 can again be rotated downward to reapply the requisite tensional force on the rod 155. In this manner, the distal nozzle portion 135 may be removably attached to the proximal nozzle portion 130 with a plurality of different orientations therebetween.

In accordance with aspects of the invention, the distal nozzle portion 135 transitions distally from a tubular shape into a mouth-like opening 200 with a first projection 205 in opposed, spaced relation to a second projection 210. The first projection 205 terminates in a first distalmost straight edge 215 and defines a first outward-facing surface 220 facing away from the second projection 210. The second projection 210 is basically a mirror image of the first projection 205. The second projection 210 terminates in a second distalmost straight edge 225 and defines a second outward-facing surface 230 facing away from the first projection 205. Both the first and second distalmost straight edges 215, 225 have a width smaller than the width of the gutter 3000.

The apparatus 100 also includes a first anti-wear plate 235 attached to the first outward-facing surface 220 of the first projection 205, and a second anti-wear plate 240 attached to the second outward-facing surface 230 of the second projection 210. The first anti-wear plate 235 and the second anti-wear plate 240 are held in place by bolts 245. In the present illustrative embodiment, each of the first and second anti-wear plates 235, 240 describes a T-shape and are formed of a different material from the first and second projections 205, 210. As will be further described below, the first and second projections 205, 210 may be formed of plastic while the first and second anti-wear plates 235, 240 may be formed of metal.

As indicated above, the nozzle assembly 120 comprises two fixed bends, the first bend 140 defined by the proximal nozzle portion 130, and the second bend 145 defined by the distal nozzle portion 135. Experimentation with prototypes of the apparatus 100 have suggested that the first bend 140 preferably be about 60 degrees. The second bend 145 is preferably about 90 degrees. These angles help to allow the user 1000 to easily obtain a comfortable position on the ground while utilizing the apparatus 100 in the manner detailed herein.

The blower 105 may comprise any type of equipment capable of providing a source of high-velocity air, such as a conventional leaf blower or a shop vacuum that is capable of blowing in addition to providing a vacuum. The blower 105 in FIG. 1, for example, is part of a conventional gas-operated backpack leaf blower, which includes a back unit 295 that provides high-velocity air through a bellow tube to the flexible tubing 110 in a manner that puts the flexible tubing 110 into gaseous communication with the blower 105.

In use, the user 1000 may stand safely on the ground next to the building 4000 and place the nozzle assembly 120 into the gutter 3000 to be cleaned with the first or second anti-wear plate 235, 240 resting on the floor of the gutter 3000 so that the apparatus 100 is in direct contact with the gutter 3000. The telescoping rigid tubing 115 may be adjusted to accommodate the height of the gutter 3000. The user 1000 may then command the blower 105 to propel high-velocity air through the nozzle assembly 120 while manipulating the nozzle assembly 120 in the gutter 3000 to cause debris 2000 therein to be expelled. During use, the user 1000 may grasp the rigid tubing 115 in order to manipulate the nozzle assembly 120 while allowing the flexible tubing 110 to drape (i.e., span) between the blower 105 and the rigid tubing 115 (FIG. 1).

Figure 7:
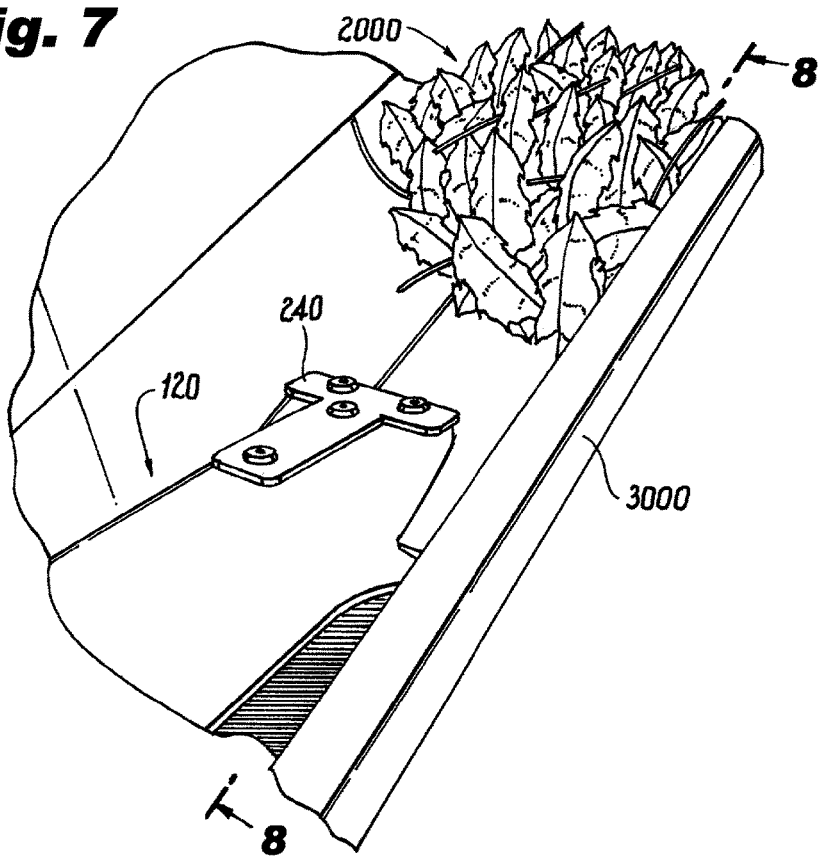
FIG. 7 shows a top perspective view of the nozzle assembly in the FIG. 1 apparatus cleaning debris from the gutter.
Figure 8:
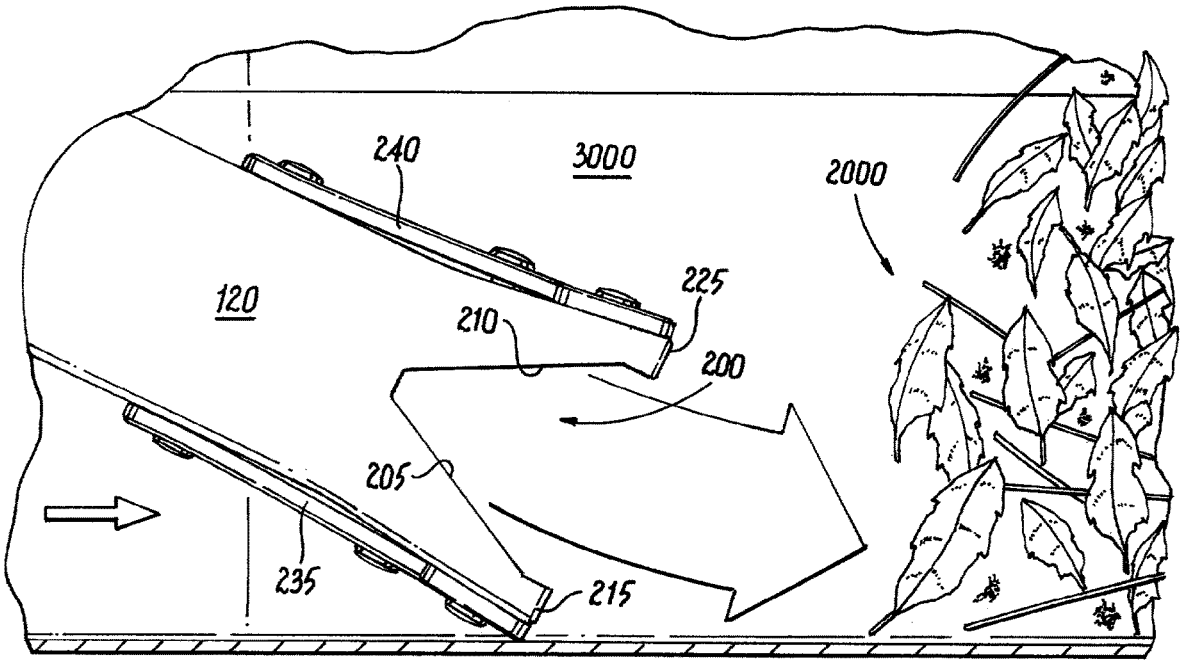
FIG. 8 shows a side elevational view of the nozzle assembly in the FIG. 1 apparatus cleaning debris from the gutter.

Effective gutter cleaning may be accomplished by walking the nozzle assembly 120 forward along the gutter 3000 from a starting point in a single direction and then, if it is felt that the gutter 3000 would benefit from another pass, resetting the nozzle assembly 120 back to the starting point so the process can be repeated. FIGS. 7 and 8 show views of the nozzle assembly 120 during the cleaning of the gutter 3000 with FIG. 7 showing a top perspective view of the nozzle assembly 120 and the gutter 3000, and FIG. 8 showing a side elevational view of these same elements. Because of the unique design of the nozzle assembly 120, air propelled through the nozzle assembly 120 departs the mouth-like opening 200 both in forward and lateral directions into the confined channel of the gutter 3000. This pattern of high-velocity air forcefully pushes the debris 2000 away from the nozzle assembly 120 and out of the gutter 3000. If a gutter hanger is encountered in the gutter 3000 when cleaning, the user 1000 may simply raise the nozzle assembly 120 over the gutter hanger using the rigid tubing 115 and then lower the nozzle assembly 120 back into the gutter 3000 so that the apparatus 100 again makes direct contact with the floor of the gutter 3000 in the manner shown in FIGS. 7 and 8.

Notably, during gutter cleaning in the manner indicated above, only the first anti-wear plate 235 or the second anti-wear plate 240 directly contacts the gutter 3000. The anti-wear plates 235, 240 thereby act to protect the nozzle assembly 120 from wear. If the anti-wear plates 235, 240 are formed of a harder, more robust material than the nozzle assembly 120, the lifespan of the apparatus 100 is substantially extended.

As indicated earlier, the relative orientation of the distal nozzle portion 135 relative to the proximal nozzle portion 130 can be altered as desired by the user 1000 when cleaning the gutter 3000 with the apparatus 100. Such a manual adjustment can be accomplished utilizing the combination of the rod 155 and the clamping handle 170 in the manner set forth above. This ability to reorient the nozzle assembly 120 is a valuable added feature of the apparatus 100. The orientation may, for example, be quickly changed when reversing the forward cleaning direction relative to the gutter 3000. At the same time, because of the complicated geometry of the apparatus 100, variations in the user's position relative to the gutter 3000 tend to translate into variations in the incident angle of the nozzle assembly 120 on the gutter 3000. The ability to easily reorient the nozzle assembly 120 ensures that the user 1000 can achieve an effective forward cleaning orientation of the nozzle assembly 120 relative to the gutter 3000 in response to these variations.

Thus, the above-described apparatus 100, and, more generally, apparatus in accordance with aspects of the invention, provide several advantages over preexisting gutter-cleaning solutions. In particular, the novel shape of the nozzle assembly 120 provides a means to effectively clean debris from gutters by allowing intimate contact between the apparatus 100 and the gutter 3000 while directing high-velocity air both forward and lateral to the nozzle assembly 120 into the confined channel defined by the gutter 3000. Even heavy objects resting in the gutter 3000, such as tree branches, may be readily expelled with this pattern of air flow. Simultaneously, the anti-wear plates 235, 240 protect the nozzle assembly 120 from contact damage from the gutter 3000. The ability to reorient the distal nozzle portion 135 relative to the proximal nozzle portion 130 and the telescoping rigid tubing 115 ensure that the user 1000 can ergonomically achieve an effective nozzle orientation relative to the gutter 3000 while safely on the ground.

Elements of the invention may be sourced from commercial vendors and/or manufactured using conventional manufacturing techniques that will be familiar to one having ordinary skill in the relevant arts. A suitable backpack leaf blower may be sourced from, for example, HUSQVARNA® PROFESSIONAL PRODUCTS INC. (Charlotte, NC, USA). Flexible and rigid tubing are commercially available from, for example, RIDGID® TOOL COMPANY (Elyria, OH, USA). Clamping handles (also called cam handles and clamping levers) capable of acting on a rod in a manner like that indicated above are commercially available from several different vendors, including, as just one example, MCMASTER-CARR® COMPANY (Elmhurst, IL, USA).

A nozzle assembly suitable for use in embodiments of the invention may be formed of, for example, polymer such as polyvinylchloride (PVC) or a fiber-reinforced polymer such as carbon-fiber impregnated polyethylene terephthalate glycol (PETG+CF). Manufacturing techniques for the nozzle assembly may include, for instance, molding, computer-numerical-control (CNC) machining, three-dimensional (3d) printing, and the like. Suitable anti-wear plates may be formed of a metal such as stainless steel and may be cut from a plate of such a metal.

It should again be emphasized that the above-described embodiments of the invention are intended to be illustrative only. Other embodiments can use different types and arrangements of elements for implementing the described functionality. These numerous alternative embodiments within the scope of the appended claims will be apparent to one skilled in the art.

For example, in alternative embodiments of the invention, anti-wear plates like the anti-wear plates 235, 240 can be eliminated in favor of a more robust nozzle assembly. Moreover, an additional rotational sleeve may be added to the nozzle assembly to provide even greater ability to finetune the orientation of the nozzle assembly relative to the gutter being cleaned. FIGS. 9 and 10 show aspects of a modified apparatus 400 in accordance with another illustrative embodiment of the invention having both of these optional alterations. FIG. 9 shows a perspective view of the modified apparatus 400 being used to clean the debris 2000 from the gutter 3000, while FIG. 10 shows a sectional view of the region of the modified apparatus 400 indicated in FIG. 9. The modified apparatus 400 includes rigid tubing 405 attached to a nozzle assembly 410 with a proximal nozzle portion 415 and a distal nozzle portion 420. The distal nozzle portion 420 transitions distally from a tubular shape into a mouth-like opening 425 in a manner similar to the distal nozzle portion 135 of the apparatus 100. However, a new rotational collar 430 is disposed in the distal nozzle portion 420 proximal of the mouth-like opening 425, allowing the mouth-like opening 425 to be independently oriented relative to a remainder of the distal nozzle portion 420. At the same time, sidewalls 435 of the distal nozzle portion 420 are thickened to allow prolonged use without the need for anti-wear plates.

All the features disclosed herein may be replaced by alternative features serving the same, equivalent, or similar purposes, unless expressly stated otherwise. Thus, unless expressly stated otherwise, each feature disclosed is one example only of a generic series of equivalent or similar features.

What is claimed is:

1. An apparatus configured to clean gutters using high velocity air, comprising:

rigid tubing; and a nozzle assembly attached to the rigid tubing and comprising:

a proximal nozzle portion characterized by a tubular shape and defining a first bend;

a distal nozzle portion rotationally attached to the proximal nozzle portion and defining a second bend, the distal nozzle portion transitioning distally from a tubular shape into a mouth-shaped opening with a first projection in fixed, opposed, and spaced relation to a second projection, the first projection defining a first outward-facing surface facing away from the second projection;

a locking mechanism comprising a rod spanning between the proximal nozzle portion and the distal nozzle portion and further comprising an eccentric clamping handle engaged with the rod, the locking mechanism operative to take on a first state and a second state, wherein rotational motion between the distal nozzle portion and the proximal nozzle portion is allowed in the first state and inhibited in the second state; and a first anti-wear plate describing a T-shape attached to the first outward-facing surface and formed of a different material therefrom.

2. The apparatus of claim 1, wherein the second projection is a mirror image of the first projection.

3. The apparatus of claim 1, wherein the first projection terminates in a first distalmost straight edge.

4. The apparatus of claim 3, wherein the second projection terminates in a second distalmost straight edge.

5. The apparatus of claim 1, wherein the first projection comprises plastic and the first anti-wear plate comprises metal.

6. The apparatus of claim 1, wherein:

the second projection defines a second outward-facing surface facing away from the first projection; and the apparatus further comprises a second anti-wear plate attached to the second outward-facing surface and formed of a different material therefrom.

7. The apparatus of claim 1, wherein an interior of the nozzle assembly is in gaseous communication with an interior of the rigid tubing.

8. The apparatus of claim 1, wherein the rigid tubing comprises a first rigid tubing segment removably joined to a second rigid tubing segment.

9. The apparatus of claim 1, wherein the distal nozzle portion is rotationally attached to the proximal nozzle portion to allow a plurality of different orientations therebetween.

10. The apparatus of claim 1, wherein actuating the eccentric clamping handle creates a tensional force on the rod.

11. The apparatus of claim 1, further comprising:

a blower; and flexible tubing spanning between the blower and the rigid tubing;

wherein the blower is operative to propel air through the flexible tubing, the rigid tubing, and the nozzle assembly.

12. The apparatus of claim 11, wherein the air propelled through the nozzle assembly departs the mouth-shaped opening in both forward and lateral directions.

13. A method comprising:

(A) obtaining an apparatus comprising:

(i) rigid tubing;

(ii) a nozzle assembly attached to the rigid tubing and comprising:

(a) a proximal nozzle portion characterized by a tubular shape and defining a first bend;

(b) a distal nozzle portion rotationally attached to the proximal nozzle portion and defining a second bend, the distal nozzle portion transitioning distally from a tubular shape into a mouth-shaped opening with a first projection in fixed, opposed, and spaced relation to a second projection, the first projection defining a first outward-facing surface facing away from the second projection;

(c) a locking mechanism comprising a rod spanning between the proximal nozzle portion and the distal nozzle portion and further comprising an eccentric clamping handle engaged with the rod, the locking mechanism operative to take on a first state and a second state, wherein rotational motion between the distal nozzle portion and the proximal nozzle portion is allowed in the first state and inhibited in the second state; and (d) a first anti-wear plate describing a T-shape attached to the first outward-facing surface and formed of a different material therefrom;

(iii) a blower; and (iv) flexible tubing spanning between the blower and the rigid tubing;

(B) placing the apparatus in contact with a gutter; and (C) propelling air from the blower through the flexible tubing, the rigid tubing, and the nozzle assembly into the gutter.

14. The method of claim 13, wherein placing the apparatus in contact with the gutter comprises placing the first anti-wear plate in contact with the gutter.

* * * * *